US011274642B1

(12) United States Patent
Stewart et al.

(10) Patent No.: US 11,274,642 B1
(45) Date of Patent: Mar. 15, 2022

(54) FUEL RAIL ASSEMBLY

(71) Applicants: DENSO International America, Inc., Southfield, MI (US); DENSO CORPORATION, Kariya (JP)

(72) Inventors: Garrett Stewart, Fenton, MI (US); Yuki Takeuchi, Kariya (JP); Steven Roseborsky, Kingsville (CA)

(73) Assignees: DENSO International America, Inc., Southfield, MI (US); DENSO CORPORATION, Kariya (JP)

( * ) Notice: Subject to any disclaimer, the term of this patent is extended or adjusted under 35 U.S.C. 154(b) by 0 days.

(21) Appl. No.: 17/462,082

(22) Filed: Aug. 31, 2021

(51) Int. Cl.
*F02M 51/00* (2006.01)
*F02M 61/14* (2006.01)
*F02M 55/02* (2006.01)

(52) U.S. Cl.
CPC ..... *F02M 51/005* (2013.01); *F02M 55/025* (2013.01); *F02M 61/14* (2013.01); *F02M 2200/855* (2013.01); *F02M 2200/856* (2013.01)

(58) Field of Classification Search
CPC .. F02M 55/004; F02M 55/005; F02M 55/025; F02M 2200/856; F02M 51/005
See application file for complete search history.

(56) References Cited

U.S. PATENT DOCUMENTS

| | | | | |
|---|---|---|---|---|
| 5,513,613 | A * | 5/1996 | Taylor | F02M 51/005 123/456 |
| 9,062,640 | B2 * | 6/2015 | Yamamoto | F02M 51/005 |
| 2019/0093614 | A1 * | 3/2019 | Renner | F02M 55/025 |

FOREIGN PATENT DOCUMENTS

| | | | | |
|---|---|---|---|---|
| CN | 201059232 | Y * | 5/2008 | |
| DE | 4317827 | A1 * | 12/1994 | F02M 51/005 |
| DE | 202014104466 | U1 * | 9/2014 | F02M 61/14 |
| DE | 102019218946 | A1 * | 6/2021 | F02M 55/025 |
| DE | 102019218948 | A1 * | 6/2021 | F02M 55/025 |
| DE | 102019218949 | A1 * | 6/2021 | F02M 55/025 |
| DE | 102019218986 | A1 * | 6/2021 | F02M 51/005 |
| EP | 3786439 | A1 * | 3/2021 | F02M 55/025 |
| JP | 2005140052 | A | 6/2005 | |
| JP | 2006161764 | A | 6/2006 | |
| JP | 201372284 | A | 4/2013 | |
| JP | 2015-001224 | A | 1/2015 | |

OTHER PUBLICATIONS

English machine translation provide by ESPACENET of Description for DE-202014104466-U1 (Year: 2021).*
English machine translation provide by ESPACENET of Abstract for DE-202014104466-U1 (Year: 2021).*

* cited by examiner

*Primary Examiner* — Michael A Kessler
(74) *Attorney, Agent, or Firm* — Harness, Dickey & Pierce, P.L.C.

(57) ABSTRACT

A fuel rail assembly for delivering fuel to at least one fuel injector. The assembly includes a main pipe defining a passageway through which fuel passes to the fuel injector. A fastener mount is forged with the main pipe such that the fastener mount is integral with the main pipe. The fastener mount defines a first aperture configured to receive a fastener for mounting the main pipe. A wire harness mount is forged with the main pipe such that the wire harness mount is integral with the main pipe. The wire harness mount defines a second aperture configured to cooperate with a coupling member of a wire harness. The fastener mount and the wire harness mount are on a common side of the main pipe.

20 Claims, 3 Drawing Sheets

FUEL RAIL ASSEMBLY

FIELD

The present disclosure relates to a fuel rail assembly for delivering fuel to an engine.

BACKGROUND

This section provides background information related to the present disclosure, which is not necessarily prior art.

A fuel rail assembly is commonly used to deliver fuel to an engine. Conventional fuel rail assemblies are comprised of numerous individual parts connected by brazing. While conventional fuel rail assemblies are suitable for their intended use, they are subject to improvement. For example, brazing is costly and may present quality control challenges. The present disclosure advantageously provides for improved fuel rail assemblies including at least the advantages set forth herein.

SUMMARY

This section provides a general summary of the disclosure, and is not a comprehensive disclosure of its full scope or all of its features.

The present disclosure provides for a fuel rail assembly for delivering fuel to at least one fuel injector. The assembly includes a main pipe defining a passageway through which fuel passes to the fuel injector. A fastener mount is forged with the main pipe such that the fastener mount is integral with the main pipe. The fastener mount defines a first aperture configured to receive a fastener for mounting the main pipe. A wire harness mount is forged with the main pipe such that the wire harness mount is integral with the main pipe. The wire harness mount defines a second aperture configured to cooperate with a coupling member of a wire harness. The fastener mount and the wire harness mount are on a common side of the main pipe.

The present disclosure further provides for a fuel rail assembly for delivering fuel to at least one fuel injector. The assembly includes a main pipe defining a passageway through which fuel passes to the fuel injector. A fastener mount is forged with the main pipe such that the fastener mount is integral with the main pipe. The fastener mount defines a first aperture configured to receive a fastener for mounting the main pipe. A wire harness mount is forged with the main pipe such that the wire harness mount is integral with the main pipe. The wire harness mount defines a second aperture configured to cooperate with a coupling member of a wire harness. An injector cup is forged with the main pipe. The injector cup defines a receptacle configured to cooperate with the fuel injector. The fastener mount is between and integral with the wire harness mount and the injector cup. A first axis extending along a first axial center of the first aperture, a second axis extending along a second axial center of the second aperture, and a third axis extending along a third axial center of the receptacle all extend in parallel.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of select embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
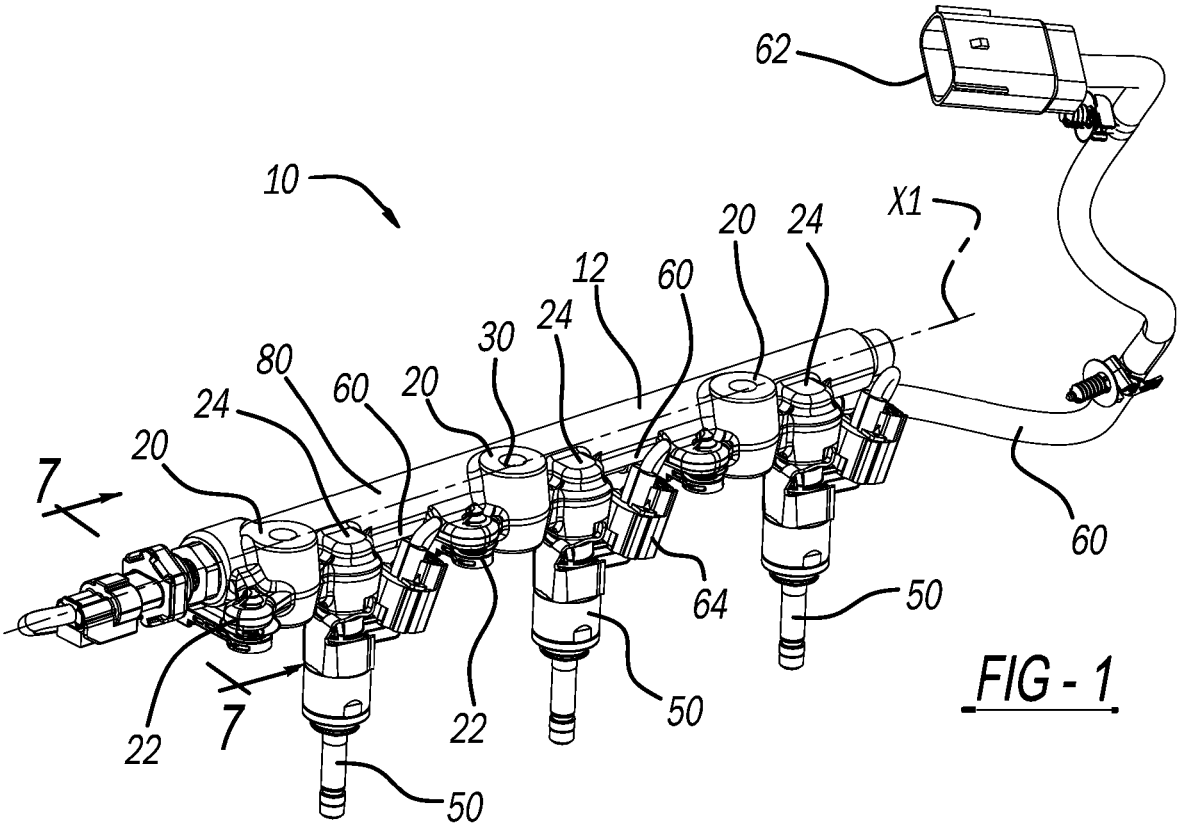
FIG. 1 is a perspective view of a fuel rail assembly in accordance with present disclosure.

FIG. 1 illustrates an exemplary fuel rail assembly 10 in accordance with the present disclosure. The assembly 10 generally includes a fuel rail or main pipe 12. The main pipe 12 defines a passageway 14 (see FIGS. 6 and 7) which extends through the main pipe 12 along an axis X1. The axis X1 extends along an axial center of the main pipe 12. The main pipe 12 is formed by forging. After the main pipe 12 is forged, the passageway 14 is machined through the main pipe 12.

Figure 2:
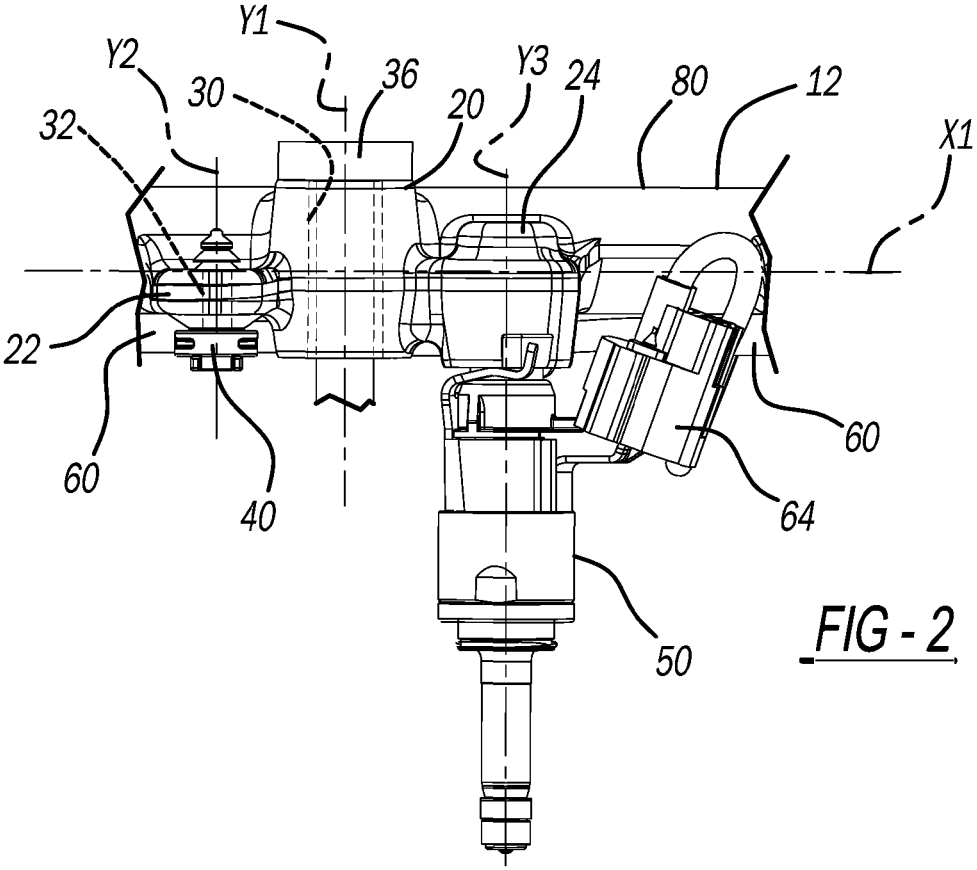
FIG. 2 is a side view of a portion of the fuel rail assembly of FIG. 1.
Figure 3:
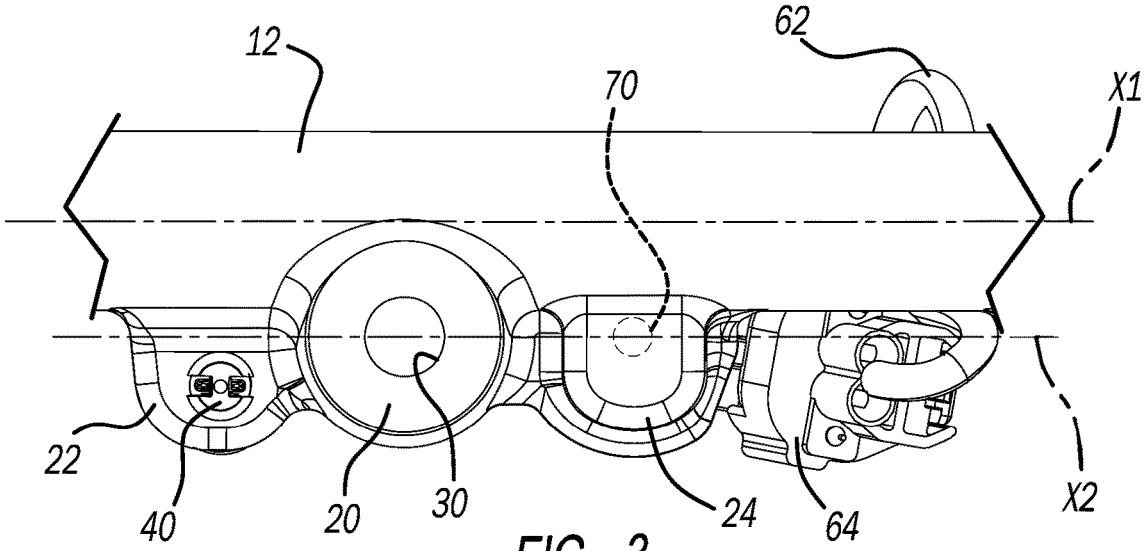
FIG. 3 is a top view of FIG. 2.
Figure 4:
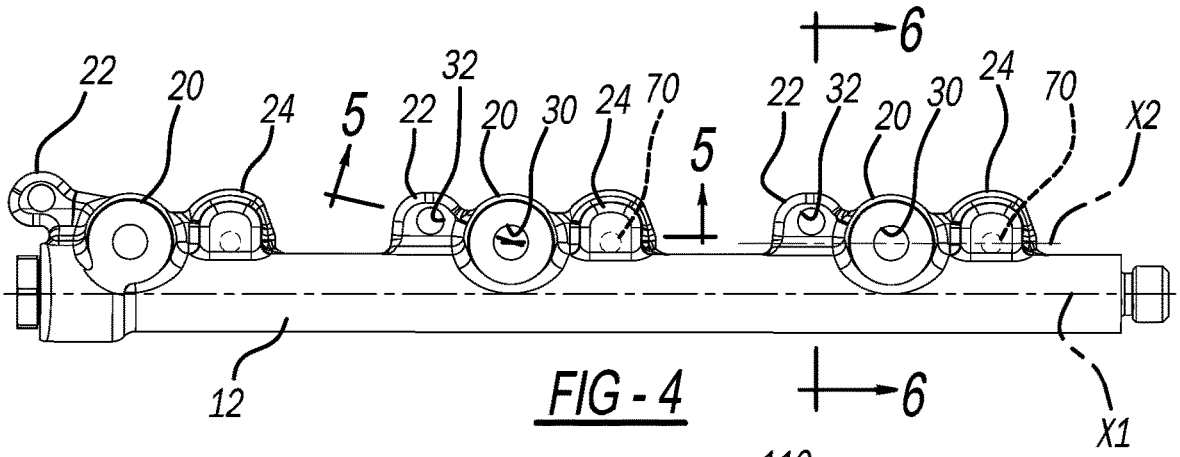
FIG. 4 is a top view of a main pipe (fuel rail) of the fuel rail assembly of FIG. 1.

With continued reference to FIG. 1, and with additional reference to FIGS. 2-4 for example, forged along with the main pipe 12 is a fastener mount 20, a wire harness mount 22, and an injector cup 24. Thus, each one of the fastener mount 20, the wire harness mount 22 and the injector cup 24 is integral with the main pipe 12. The fastener mount 20 is between the wire harness mount 22 and the injector cup 24. The fastener mount 20 is integral with both the wire harness mount 22 and the injector cup 24. Forging and machining advantageously improves the accuracy of the relative positioning of the fastener mount 20, the wire harness mount 22, and the injector cup 24.

Each one of the fastener mount 20, the wire harness mount 22, and the injector cup 24 is forged on a common side of the main pipe 12. Forging each one of the fastener mount 20, the wire harness mount 22, and the injector cup 24 integrally with the main pipe 12 advantageously eliminates any need to provide connections to the main pipe 12, thereby reducing manufacturing costs and improving manufacturing time. Arranging each one of the fastener mount 20, the wire harness mount 22, and the injector cup 24 on the same side of the main pipe 12 reduces the amount of base material required for forging, thereby further reducing costs.

With particular reference to FIGS. 1 and 4, the fuel rail assembly 10 includes a plurality of fastener mounts 20, wire harness mounts 22, and injector cups 24 along the main pipe 12. Each one of the fastener mounts 20, the wire harness mounts 22, and the injector cups 24 are forged integral with the main pipe 12. The fastener mounts 20, the wire harness mounts 22, and the injector cups 24 are arranged in groups, with each group evenly spaced apart along the main pipe 12. Each group is on a common side of the main pipe 12. Each group includes the fastener mount 20 between, and forged integrally with, one of the wire harness mounts 22 and one of the injector cups 24. Each one of the fastener mounts 20, each one of the wire harness mounts 22, and each one of the injector cups 24 are substantially similar or are the same. Therefore, the description herein of the fastener mount 20, the wire harness mount 22, and the injector cup 24 also describes the other fastener mounts 20, wire harness mounts 22, and injector cups 24 respectively.

Figure 5:
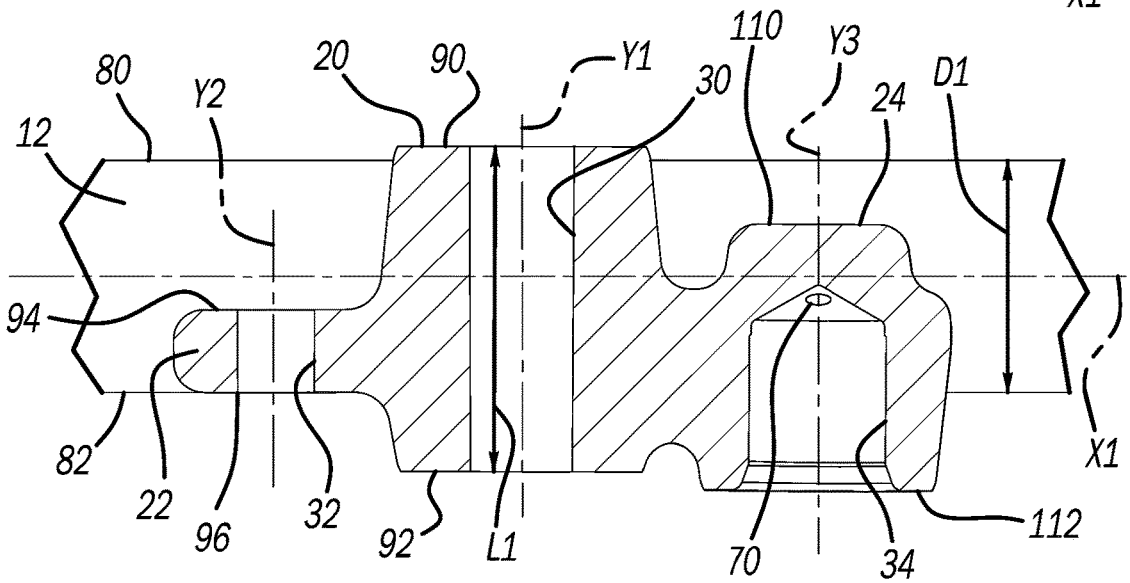
FIG. 5 is a cross-sectional view taken along line 5-5 of FIG. 4.

The fastener mount 20 defines a first aperture 30 extending therethrough. The wire harness mount 22 defines a second aperture 32 extending therethrough. With particular reference to FIG. 5, the injector cup 24 defines a receptacle 34 therein. The first aperture 30 extends along a first axis Y1. The second aperture 32 of the wire harness mount 22 extends along a second axis Y2. A third axis Y3 extends along an axial center of the receptacle 34. Each one of the first axis Y1, the second axis Y2, and the third axis Y3 extend parallel to one another, and perpendicular to the axis X1 of the main pipe 12. Each one of the first aperture 30, the second aperture 32, and the receptacle 34 is machined. Machining the first aperture 30, the second aperture 32, and the receptacle 34 such that the first axis Y1, the second axis Y2, and the third axis Y3 are parallel to each other facilitates the machining process because, for example, each one of the first aperture 30, the second aperture 32, and the receptacle 34 may be machined by making only minimal tooling adjustments.

The first aperture 30 of the fastener mount 20 is configured to receive any suitable fastener 36, such as a bolt for example, for mounting the main pipe 12 at any suitable location proximate to an engine so that the fuel rail assembly 10 may deliver fuel to the engine. The second aperture 32 of the wire harness mount 22 is configured to receive any suitable coupling member 40 for retaining a wire harness 60 against the main pipe 12, as explained further herein. The receptacle 34 is configured to receive any suitable fuel injector 50. The fuel injector 50 is configured to deliver fuel from the main pipe 12 into any suitable engine. The fuel injector 50 is connected to the wire harness 60. The wire harness 60 includes a main connector 62 and a plurality of additional connectors 64. Each one of the connectors 64 is connected to a different one of the fuel injectors 50. The wire harness 60 extends along the main pipe 12, as explained further herein. Arranging the connectors 64 such that each connector 64 is between one of the harness mounts 22 and one of the injector cups 24 advantageously reduces vibration in the fuel rail assembly 10.

With particular reference to FIGS. 3-5, each one of the receptacles 34 includes an injector hole 70, which is in fluid communication with the passageway 14. Fuel from the main pipe 12 enters the receptacle 34 through the injector hole 70 and flows into the fuel injector 50. The injector hole 70 is arranged along the third axis Y3, as illustrated in FIG. 5 for example. The injector hole 70 is aligned with the first aperture 30 along alignment axis X2, as illustrated in FIG. 3 for example. The alignment axis X2 extends parallel to, or generally parallel to, the longitudinal axis X1 of the main pipe 12. The second aperture 32 may be along the alignment axis X2 or slightly offset therefrom. The first aperture 30 is also aligned with the second aperture 32 of the wire harness mount 22.

With particular reference to FIG. 5, the fastener mount 20 includes an upper surface 90 and a lower surface 92, which are at opposite ends of the first aperture 30. The wire harness mount 22 includes an upper surface 94 and a lower surface 96, which are at opposite ends of the second aperture 32. The injector cup 24 has an upper surface 110 and a lower surface 112, which are at opposite ends of the injector cup 24.

Figure 6:
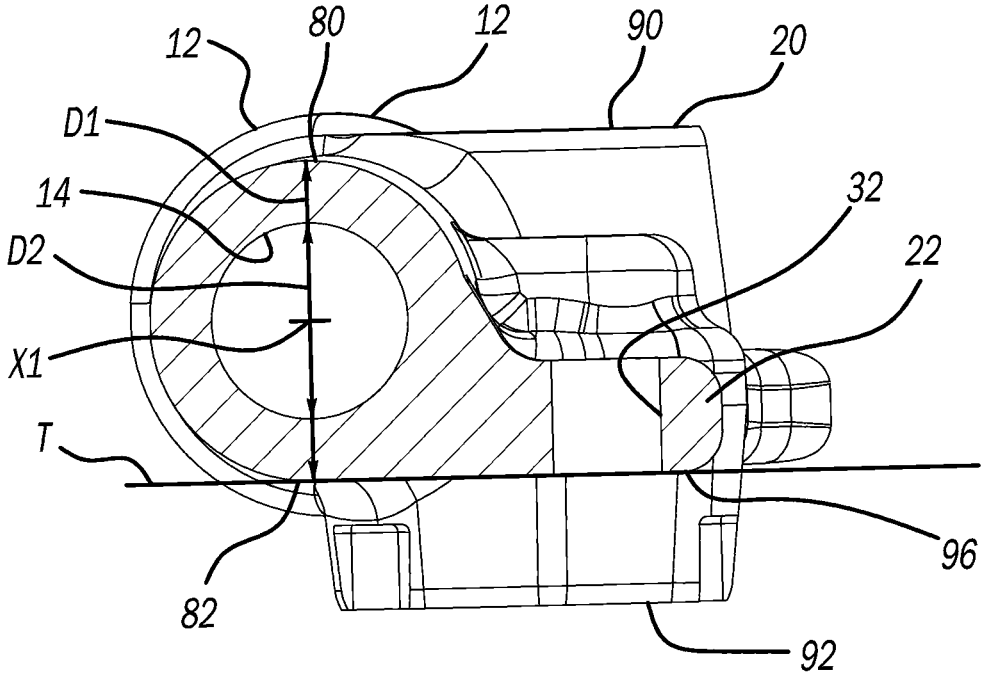
FIG. 6 is a cross-sectional view of the main pipe taken along line 6-6 of FIG. 4.

The main pipe 12 has an upper pipe surface 80 and a lower pipe surface 82, which is opposite to the upper pipe surface 80. The main pipe 12 has an outer diameter D1, which extends between the upper pipe surface 80 and the lower pipe surface 82 (FIG. 5, for example). The passageway 14 of the main pipe 12 has a diameter D2, as illustrated in FIGS. 6 and 7.

The fastener mount 20 is forged with the main pipe 12 such that the upper surface 90 of the fastener mount 20 is in a plane above the upper pipe surface 80 of the main pipe 12, and the lower surface 92 of the fastener mount 20 is in a plane below the lower pipe surface 82. The first aperture 30 is thus longer than the diameter D1 of the main pipe 12 (i.e., L1>D1 in FIG. 5). The wire harness mount 22 is forged to the main pipe 12 such that the upper surface 94 of the wire harness mount 22 is in a plane below the upper surface 90 of the fastener mount 20, and the lower surface 96 of the wire harness mount 22 is above the lower surface 92 of the fastener mount 20. The upper surface 94 of the wire harness mount 22 is in a plane below the upper pipe surface 80. The lower surface 96 of the wire harness mount 22 is aligned with, and thus lies tangent to, the lower pipe surface 82 along tangent line T of FIG. 6. The lower surface 96 is planar proximate to the second aperture 32 and lies along the tangent line T. As a result, a head 42 of the coupling member 40 sits flush against, or generally flush against, the lower surface 96, as illustrated in FIG. 7. Because the lower surface 96 is planar and extends along the tangent line T, the length/thickness of the second aperture 32 is kept constant, the second aperture 32 may be arranged close to the main pipe 12, and the size of the wire harness mount 22 may be advantageously kept to a minimum. Forming the lower surface 96 tangent to the lower pipe surface 82 also advantageously facilitates the forging process. Because the upper surface 90 and the lower surface 92 of the fastener mount 20 protrude beyond the upper pipe surface 80 and the lower pipe surface 82, respectively, the upper and lower surfaces 90, 92 may be easily cut with a large diameter and milled without contacting the main pipe 12.

Figure 7:
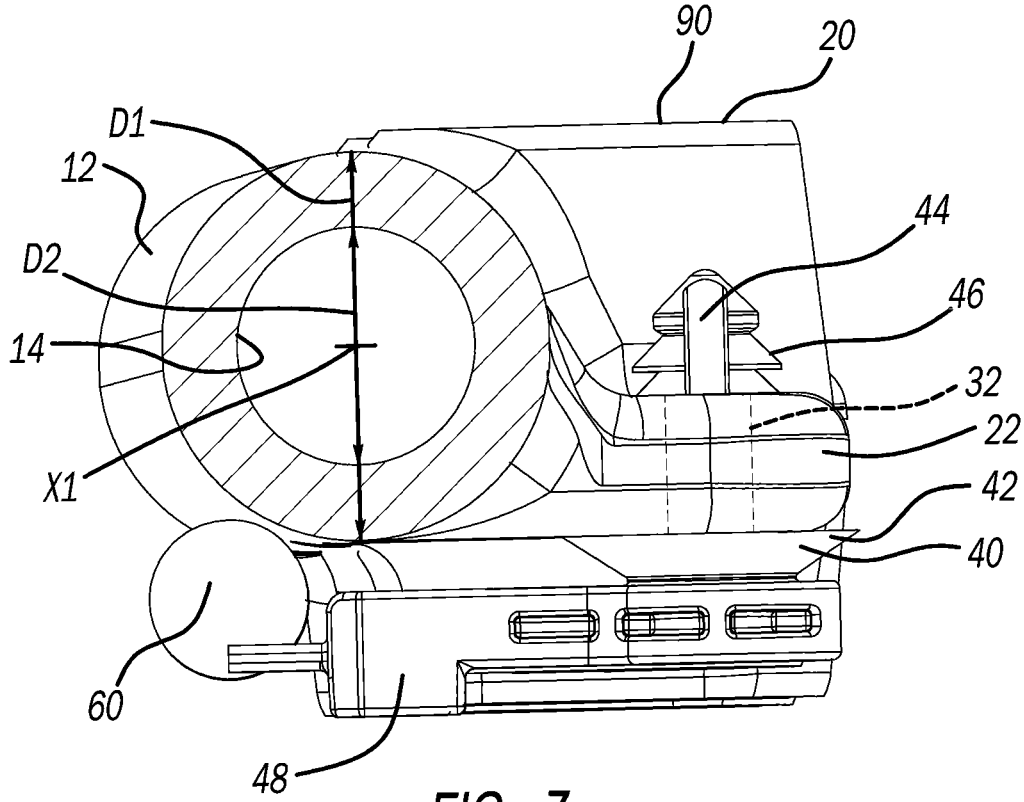
FIG. 7 is a cross-sectional view taken along line 7-7 of FIG. 1.

In the example of FIG. 7, the coupling member 40 is configured as a fixed clip (sometimes referred to in the art as a "Christmas tree" clip) including the head 42, a post 44 extending from the head 42, and a plurality of flexible tabs 46 extending outward from the post 44. The coupling member 40 is coupled to the wire harness mount 22 by inserting the post 44 into the second aperture 32 from the lower surface 96 such that the head 42 sits flush against the lower surface 96, and a portion of the post 44 extends out from within the second aperture 32 beyond the upper surface 94. Beyond the upper surface 94, the flexible tabs 46 expand to retain the coupling member 40 in cooperation with the wire harness mount 22. Connected to the coupling member 40 is a wire support member 48. The wire support member 48 is configured to support the wire harness 60 against, or closely adjacent to, the main pipe 12. The wire harness 60 is arranged and supported such that it extends generally parallel to the axis X1.

Each one of the wire harness mounts 22 includes one of the coupling members to secure the wire harness 60 along the length of the main pipe 12. Because the wire harness mounts 22 are evenly spaced apart along the length of the main pipe 12, little or no vibration is transferred from the main pipe 12 to the wire harness 60, which advantageously reduces any possibility of the connectors 64 becoming disconnected from the fuel injectors 50.

The injector cup 24 is forged with the main pipe 12 such that the upper surface 110 of the injector cup 24 is in a plane below both the upper surface 90 of the fastener mount 20 and the upper pipe surface 80. The upper surface 110 of the injector cup 24 is in a plane above the upper surface 94 of the wire harness mount 22. The lower surface 112 of the injector cup 24 is in a plane below each one of the lower pipe surface 82, the lower surface 96 of the wire harness mount 22, and the lower surface 92 of the fastener mount 20. Thus only the upper surface 90 of the fastener mount 20 is in a plane above the upper pipe surface 80, but only slightly above the upper pipe surface 80 so as to keep the overall height of the fuel rail assembly 10 to a minimum.

FIG. 2 illustrates the exemplary fastener 36 seated in the first aperture 30 of the fastener mount 20. When fuel pressure is applied to the injector cup 24, a reaction force of the fuel pressure is exerted upon the injector cup 24. With the axis of the fastener 36 considered as a fulcrum, the direction of any bending of the injector cup 24 is advantageously confined to along the third axis Y3 to protect the connection between the injector cup 24 and the fuel injector 50 because axis Y1 extends parallel to the third axis Y3. Because the first aperture 30 of the fastener mount 20 and the injector hole 70 are collinear along alignment axis X2 (see FIG. 3, for example), any displacement of the injector cup 24 due to fuel pressure force can be suppressed, such as by an O-ring seated in the receptacle 34, which advantageously reduces wear.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claimed is:

1. A fuel rail assembly for delivering fuel to at least one fuel injector, the fuel rail assembly comprising:

a main pipe defining a passageway through which fuel passes to the fuel injector;

a fastener mount forged with the main pipe such that the fastener mount is integral with the main pipe, the fastener mount defining a first aperture configured to receive a fastener for mounting the main pipe; and a wire harness mount forged with the main pipe such that the wire harness mount is integral with the main pipe, the wire harness mount defining a second aperture configured to cooperate with a coupling member of a wire harness;

wherein the fastener mount and the wire harness mount are on a common side of the main pipe.

2. The fuel rail assembly of claim 1, wherein the fastener mount and the wire harness mount are forged integral with each other.

3. The fuel rail assembly of claim 1, wherein the fastener mount and the wire harness mount are aligned with each other.

4. The fuel rail assembly of claim 1, wherein the first aperture and the second aperture extend parallel to each other such that a first axis extending along a first axial center of the first aperture extends parallel to a second axis extending along a second axial center of the second aperture.

5. The fuel rail assembly of claim 1, wherein the first aperture is longer than the second aperture.

6. The fuel rail assembly of claim 1, further comprising an injector cup forged with the main pipe, the injector cup configured to cooperate with the fuel injector.

7. The fuel rail assembly of claim 6, wherein the injector cup is integral with the fastener mount.

8. The fuel rail assembly of claim 6, wherein the fastener mount is between, and integral with, the injector cup and the wire harness mount.

9. The fuel rail assembly of claim 4, further comprising an injector cup forged with the main pipe, the injector cup defines a receptacle configured to cooperate with the fuel injector, a third axis extends along a third axial center of the receptacle;

wherein each one of the first axis, the second axis, and the third axis extend parallel to each other.

10. The fuel rail assembly of claim 6, wherein:

the wire harness mount lies in a first plane between an upper surface and a lower surface of the fastener mount; and the wire harness mount lies in the first plane between an upper surface and a lower surface of the injector cup.

11. The fuel rail assembly of claim 10, wherein the first aperture has a length that is greater than a maximum diameter of the main pipe such that an upper surface of the fastener mount lies in a second plane above an upper pipe surface of the main pipe, and the lower surface of the fastener mount lies in a third plane below a lower pipe surface of the main pipe.

12. The fuel rail assembly of claim 6, wherein the injector cup defines an injector hole through which fuel from the main pipe flows, the injector hole is aligned with the first aperture of the fastener mount along an alignment axis extending parallel to the main pipe.

13. The fuel rail assembly of claim 1, wherein the fastener mount is one of a plurality of fastener mounts forged with the main pipe and evenly spaced apart along a length of the main pipe; and wherein the wire harness mount is one of a plurality of wire harness mounts forged with the main pipe and evenly spaced apart along the length of the main pipe.

14. The fuel rail assembly of claim 1, wherein an undersurface of the second aperture of the wire harness mount is tangent to a main pipe undersurface of the main pipe.

15. The fuel rail assembly of claim 1, wherein the wire harness extends along the main pipe and is adjacent to the main pipe when the coupling member of the wire harness is seated in the second aperture of the wire harness mount.

16. A fuel rail assembly for delivering fuel to at least one fuel injector, the fuel rail assembly comprising:

a main pipe defining a passageway through which fuel passes to the fuel injector;

a fastener mount forged with the main pipe such that the fastener mount is integral with the main pipe, the fastener mount defining a first aperture configured to receive a fastener for mounting the main pipe;

a wire harness mount forged with the main pipe such that the wire harness mount is integral with the main pipe, the wire harness mount defining a second aperture configured to cooperate with a coupling member of a wire harness; and an injector cup forged with the main pipe, the injector cup defining a receptacle configured to cooperate with the fuel injector;

wherein the fastener mount is between and integral with the wire harness mount and the injector cup; and wherein a first axis extending along a first axial center of the first aperture, a second axis extending along a second axial center of the second aperture, and a third axis extending along a third axial center of the receptacle all extend in parallel.

17. The fuel rail assembly of claim 16, wherein each one of the fastener mount, the wire harness mount, and the injector cup are on a common side of the main pipe.

18. The fuel rail assembly of claim 16, wherein the injector cup defines an injector hole through which fuel from the main pipe flows, the injector hole is aligned with the first aperture of the fastener mount along an alignment axis extending parallel to the main pipe.

19. The fuel rail assembly of claim 16, wherein:

the wire harness mount lies in a first plane between an upper surface and a lower surface of the fastener mount; and the wire harness mount lies in the first plane between an upper surface and a lower surface of the injector cup.

20. The fuel rail assembly of claim 16, wherein the injector cup defines an injector hole through which fuel from the main pipe flows, the injector hole is aligned with the first aperture of the fastener mount along an alignment axis extending parallel to the main pipe.

* * * * *